US006236009B1

(12) United States Patent
Emigh et al.

(10) Patent No.: US 6,236,009 B1
(45) Date of Patent: May 22, 2001

(54) APPARATUS AND METHOD FOR DETECTING AND MARKING INDICIA ON ARTICLES

(76) Inventors: Jonathan D. Emigh, 7050 Mount Aukum Rd. #5, Somerset, CA (US) 95684; Motaz Qutub, 21650 Bates Cir., El Dorado Hills, CA (US) 95762; Raymond P. Porter, P.O. Box 188, Grizzly Flat, CA (US) 95636

( * ) Notice: Subject to any disclaimer, the term of this patent is extended or adjusted under 35 U.S.C. 154(b) by 0 days.

(21) Appl. No.: 09/443,068

(22) Filed: Nov. 18, 1999

(51) Int. Cl.[7] ..... B07C 5/00

(52) U.S. Cl. ..... 209/584; 209/576; 209/577; 209/583

(58) Field of Search ..... 209/584, 583, 209/576, 577

(56) References Cited

U.S. PATENT DOCUMENTS

| | | | | |
|---|---|---|---|---|
| 3,652,828 | * | 3/1972 | Sather et al. | 235/61.11 E |
| 5,223,915 | * | 6/1993 | Neri | 356/394 |
| 5,232,212 | * | 8/1993 | Weber | 271/11 |
| 5,317,654 | * | 5/1994 | Perry et al. | 382/61 |
| 5,403,398 | * | 4/1995 | Riess et al. | 118/681 |

* cited by examiner

*Primary Examiner*—Donald P. Walsh
*Assistant Examiner*—Mark J. Beauchaine

(74) *Attorney, Agent, or Firm*—R. Michael West; Boutin, Dentino, Gibson, Di Giusto, Hodell & West

(57) ABSTRACT

An apparatus and a method for detecting indicia on articles. The indicia act to identify a group of articles, having a common characteristic. The articles may be address panels used in mass mailings. Particular address panels, representing the beginning or end of a zip code or a postal delivery route, are pre-marked with one or more special indicia. The apparatus includes a scanning station, a computerized system controller, and a marking station. The scanning station includes a video camera, a video analyzer, a camera controller, and a video monitor. The video camera is programmable by using the camera controller and the video monitor, to scan only a predetermined operative scanning area of each article. The video analyzer assess each pixel within the scanning area and adds up the total number of pixels having a desired characteristic. If the pixel count satisfies predetermined criteria correlating to the presence of an indicia, the article is electronically tagged by the system controller. Then, the article is inserted into a container. In response to an electronic marking signal from the system controller, the container is physically marked at the marking station, for subsequent identification of the group.

20 Claims, 8 Drawing Sheets

APPARATUS AND METHOD FOR DETECTING AND MARKING INDICIA ON ARTICLES

BACKGROUND OF THE INVENTION

1. Field of the Invention

The invention relates generally to devices for loading items of mail, such as envelopes, with bills and informational inserts, marking certain of the envelopes in accordance with predetermined criteria, and segregating marked and associated envelopes into like groups in preparation for subsequent mail processing and delivery. More specifically, the invention pertains to an apparatus which employs a computer controlled optical scanning station, adapted to determine whether a particular marking or indicia is present on a sheet of paper such as an address panel. If the scanning station does detect such indicia, a marking station is subsequently actuated to mark a peripheral external edge portion of an envelope containing the address panel.

2. Description of the Prior Art

The processing of bulk mail containing items such as utility bills, advertisements, and the like, poses unique problems both for the mailing company and for the postal system. The postal system provides lower postal rates to mailing companies which organize the mail envelopes into physically segregated bundles or stacks corresponding to particular zip codes or postal delivery routes. These lower rates are very advantageous when thousands of pieces of mail are sent per month. The problem posed to the mailing companies is how to recognize zip code or routing "breaks" which occur when a new piece of mail is printed with a different zip code or corresponds to a different postal route than that of the previous piece of mail. When thousands of envelopes are processed a day, identifying the beginning of a new "break" is both tedious and time consuming.

Typically, bulk mailings are made using an envelope which include a transparent window on the front panel of the envelope. An address panel, or sheet is inserted into the envelope so that printed information on the address panel can be read through the transparent window. This information typically includes the name, address, and zip code of the customer or addressee, and may also be printed with billing information and other customer data. Other sheets of paper, known as inserts, may accompany the address panel in the envelope. The inserts usually pertain to an offer or a solicitation to the customer, to purchase other goods or services. An apparatus known as an inserting machine receives a previously printed address panel which is oriented facing downwardly. Then, the inserting machine stacks the appropriate kind and number of inserts over the backside of the address panel. The assembled panel and insert stack are then inserted into an envelope, and the envelope is thereafter sealed.

Sealed envelopes are transported to a tray, where they are arranged in faced relation with their lateral edges upstanding. At this juncture, an inserting machine operator manually searches through the envelopes, determining first where the zip code or route breaks exist, and then physically segregating the stack of like envelopes from the next group. To facilitate the visual recognition process, the industry has developed various means for edge marking certain envelopes which correspond to the occurrence of a zip code or tray break.

One type of marking system is known as an integrated envelope insertion system. In an integrated system, all of the components necessary to print, collate, and insert items into an envelope are located at a single site, and all of the components are physically and functionally integrated to work together. These components would typically include a paper handling cutter or a sheet feeder, and a document collator, all located adjacent and immediately upstream from the inserting machine. Owing to the number of machines whose operation must be coordinated and timed to function together, integrated systems require the use of sophisticated computers, to keep track of each and every document as it travels through the material handing apparatus.

The integrated marking system has a number of significant drawbacks. Integrated systems are inherently expensive, because the control computer must have large and fast processing capabilities. The control computer must synchronize the operation of each of the different components, and maintain all of the data relating to each item of mail as it passes through the system. Integrated systems also lack flexibility, as the components will only work together as a system. Smaller companies cannot easily upgrade their existing stand-alone components, as they are not compatible with those of the integrated system. Integrated systems also mandate that all material processing steps be undertaken and completed at a single location. This may not be desirable for a company which specializes, for example, in providing envelope inserting services only, or which desires to locate certain mail handling and processing components at different sites or in different buildings.

In a non-integrated system, the address panels and the billing documents may be generated at a remote location, and later transported to an inserting machine site. At the site, address panels and any associated billing documents are stack loaded into a hopper of the inserting machine. Then, an address panel and the billing documents are collated with advertising inserts targeted for that particular customer, and loaded into an individual envelope. A non-integrated system does not require a computer control system, as the document generation and envelope loading processes are broken up into two distinct operations, which have no temporal or physical relationship. Because of their simplicity, non-integrated systems are more reliable, and easier to set up for different inserting operations, than integrated systems.

Prior art marking devices employ a number of different indicia detection systems, including bar code readers, Optical Mark Recognition ("OMR"), and Optical Character Recognition ("OCR"). Each of these indicia detection systems has its own unique advantages and disadvantages.

For example, the bar code system requires a special printer, to mark the address panel. Also, the bar code printing must be of sufficient size and positioned within a predictable viewing location, so that reliable readings may be made. The bar code system is also disfavored for letter marking purposes because the bar code marking is considered unsightly by consumers.

OMR systems use a single sensor that simply reads the presence or absence of a mark appearing in a predetermined location. Because of variances in the reflectivity of the sheet material, extraneous readings from ambient light, and imprecise location of the mark or the sheet when the reading is made, the OMR systems tend to be unreliable in practical applications.

OCR technology is more sophisticated and reliable than OMR technology, but it is also considerably more expensive to implement. OCR systems are designed to recognize a particular character, or a group of characters, having a specific shape or configuration. Because OCR systems must be programmed to make such recognitions, each change in the indicia or characters requires reprogramming, and down time in the operation of the machine. Thus, the OCR system is less flexible in circumstances where the different mail inserting jobs to be completed have different characters, requiring time consuming reprogramming for each job setup.

As a consequence, none of the prior art systems is easily adaptable to new or changed circumstances in the operational parameters for indicia recognition. For example, if the physical location of the indicia on the address panel is changed, the physical location of the detector will have to be moved, calibrated, and tested. This is time consuming and very inefficient, particularly where indicia changes are made often. If the size or configuration of the indica is changed, the prior art systems may not be adaptable to recognize the new indicia, in all circumstances. Also, the OCR system will only recognize new characters if it has appropriately been programmed, and if the characters are such that they can reliably be differentiated from other similar appearing characters. And, the bar code system requires bar code markings which must be fairly large in size for reliable operation, so reduction in indicia size particularly for this system, has a practical limit.

SUMMARY OF THE INVENTION

The present invention comprises a non-integrated marking system, preferably for use with envelopes containing a pre-marked customer address panel. The system includes an optical scanning station, a computerized system controller, and a marking station. The scanning station is mounted on a document inserting machine, adjacent the document hopper designated for holding a stack of customer address panels. Typically, the address panel hopper is the first in a line of a plurality of document hoppers included in the machine. However, this is a matter of user selection, as the address panel hopper does not have to be the first document hopper in all circumstances. A stack of previously printed label address panels is loaded into the designated hopper, with the customer addresses and other indicia on all panels facing downwardly. The remaining hoppers of the inserting machine are loaded with sheet inserts, containing advertisements, special offers, and customer notices.

The scanning station includes a video camera having a video analyzer, a camera controller, and a video monitor. The video camera is located beneath the address panel hopper, with its lens directed upwardly toward the face of the lowermost address panel. Typically, a considerable area of the address panel, including the customer's address and any pre-marked indicia appearing thereon, is within the field of view of the camera's lens. The camera's field is constantly displayed on the video monitor for the machine operator to review.

The camera controller is interconnected to the video camera. The camera controller includes a special calibration mode. In the calibration mode, the user selects a smaller, predetermined area, within the camera's larger field of view, for the operative scanning area of the camera. This is accomplished by the operator viewing an actual address panel on the video monitor, and electronically drawing a small box or rectangle around the area where the pre-marked indicia of interest appear. By appropriately locating and sizing the operative scanning area, other extraneous marking on the address panel, such as the customer's name and address, are located outside the operative scanning area. In this manner, the camera's output to its internal video analyzer includes pixel data which pertains only to the operative scanning area.

The video analyzer includes counter and comparative circuitry which determines whether the number of black pixels counted within the operative scanning area falls within, above, or below threshold values, predetermined by the user. If the pixel count falls within a median range of these values, the video analyzer determines that one indicia is present, and a first control signal, corresponding to a short envelope mark, is outputted. If the pixel count exceeds a high value, the video analyzer determines that two indicia are present, and second control signal, corresponding to a long envelope mark, is outputted. If the pixel count falls below a low value, the video analyzer determines that no indicia are present, and a third control signal, corresponding to an absence of an envelope mark, is outputted.

If the location, size, shape, or the number of the pre-marked indicia are changed, the operator merely relocates and adjusts the boundaries of the operative scanning area to encompass the new markings, and calibrates the threshold values appropriately.

The system controller is interconnected to the three outputs of the video analyzer and an inserter position sensor. The position sensor provides information to the system controller about where the inserter is within its repetitive cycle. The position sensor enables the system controller to sample the output of the video analyzer, at the proper moment when a new address panel is ready for scanning within the address panel hopper. The system controller also monitors the output of an envelope presence sensor, located at the marking station. If an envelope is not detected at the marking station at a time when an envelope should be marked, the system controller delays the marking process until the next envelope is detected.

Lastly, the system controller includes an output interconnected to an electric solenoid at the marking station. The system controller is programmed to actuate the solenoid only when: (1) an envelope is detected at the marking station; and, (2) that envelope has previously been determined as containing an address panel, with either one or two marks or indicia. Under an occasional fault condition, which arises when the envelope which was to have been marked is not detected at the marking station, the system controller is programmed to wait until the next envelope is detected at the marking station, and then it actuates the marking solenoid to mark that envelope.

When actuated, the electric solenoid is effective to rotate a circular ink marking pad against either the passing bottom edge or the top edge of the envelope, depending upon how the envelopes are to be arranged at a downstream envelope collection tray. Either a short or a long mark is placed on the edge, depending respectively upon whether one or two of the pre-marked indicia had previously been detected when the envelope panel was in the address panel hopper.

After passing the marking station, the envelopes are successively driven onto the collection tray, where they may be arranged in front-to-back, faced relation with a contingent envelope, with the side edges of the envelopes vertically oriented, and their top edges facing upwardly. Alternatively, the envelopes may be assembled in a flat, shingled line, with their bottom edges exposed. By looking down upon the stack or line of envelopes, the machine operator can readily see any short or long marks on the exposed top or bottom edges of the envelopes. In that manner, "breaks" in the zip codes or postal routes are identified, so that the groups of envelopes, having a like characteristic, can physically be separated from each other.

It is an object, therefore, of the present disclosure to teach an apparatus and a method for optically detecting and sampling indicia upon an article, and then, based upon a comparison of the sampled data with predetermined criteria, marking an external portion of a container for that article, if the predetermined criteria are satisfied.

It is also an object of the present invention to provide a non-integrated inserting machine which incorporates a unique apparatus for detecting pre-marked indicia on an address panel, and then marking another indicia on an external portion of an envelope containing that panel, so envelopes can readily and quickly be segregated into appropriate groups for mail processing, such as common zip codes and postal routes.

Another object of the invention is to provide an apparatus and a method, which employ optical means to recognize a wide variety of shapes, locations, and numbers of indicia on an address panel for a piece of mail.

Yet another object of the invention is to provide a means responsive to control signal, for automatically marking an external portion of an envelope with an indicia corresponding to the beginning of a new group of envelopes requiring similar processing for mail handling purposes.

Yet another object of the invention is to provide a method for calibrating and operating an optical detection system using pixel count analysis of indicia within a predetermined region or area of an address panel, so that indicia having different shapes, locations and numbers can be detected reliably.

The preceding objects, as well as others will become apparent, in the drawings and the written description of the invention to follow.

DETAILED DESCRIPTION OF THE PREFERRED EMBODIMENT

Turning now to the drawings, an envelope inserting apparatus 11 modified to include the components of the present invention is shown. A general description of the components and operation of the apparatus 11 will first be provided. Then, a detailed description of the structure and operational features of the device made the subject of the present invention will follow.

Figure 1:
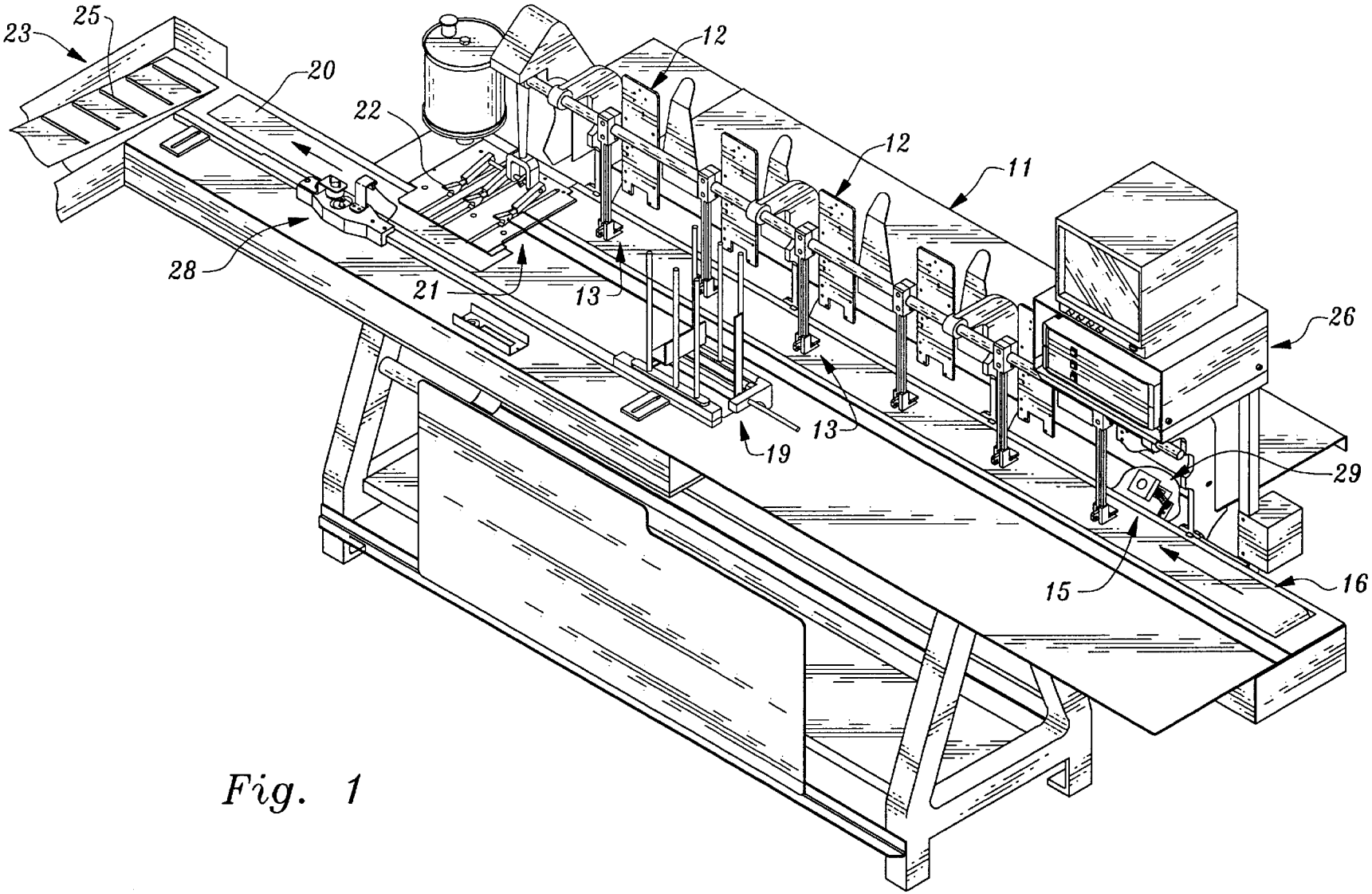
FIG. 1 is a right front perspective view of an envelope insertion apparatus, modified to incorporate the features of the present invention, a portion of the bottom plate within the address panel hopper being broken away to show a video camera.
Figure 2:
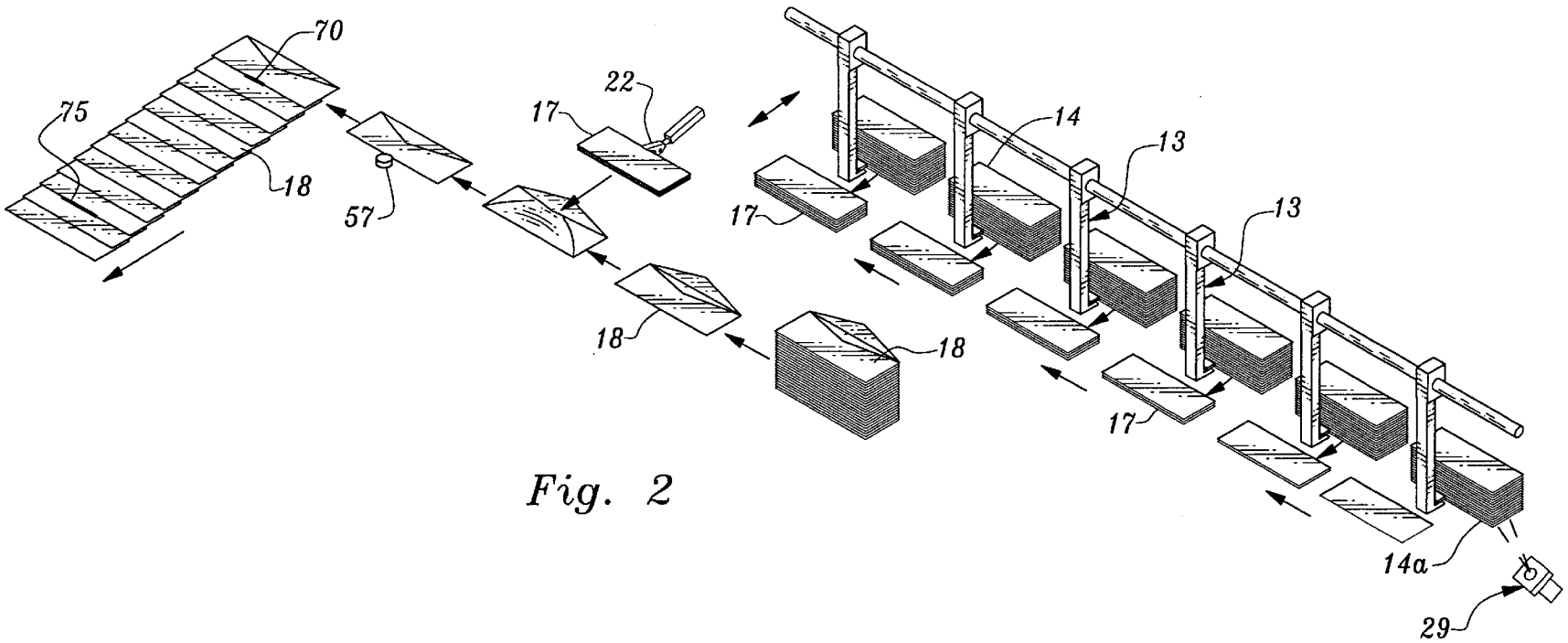
FIG. 2 is a simplified schematic representation, showing the optical detection of the address panel, the assembly and stacking of inserts on the address panel, the insertion of the panel and the inserts into an envelope, the edge marking of an envelope, and the "shingled" arrangement of the envelopes within a collection tray in horizontally offset relation.
Figure 3:
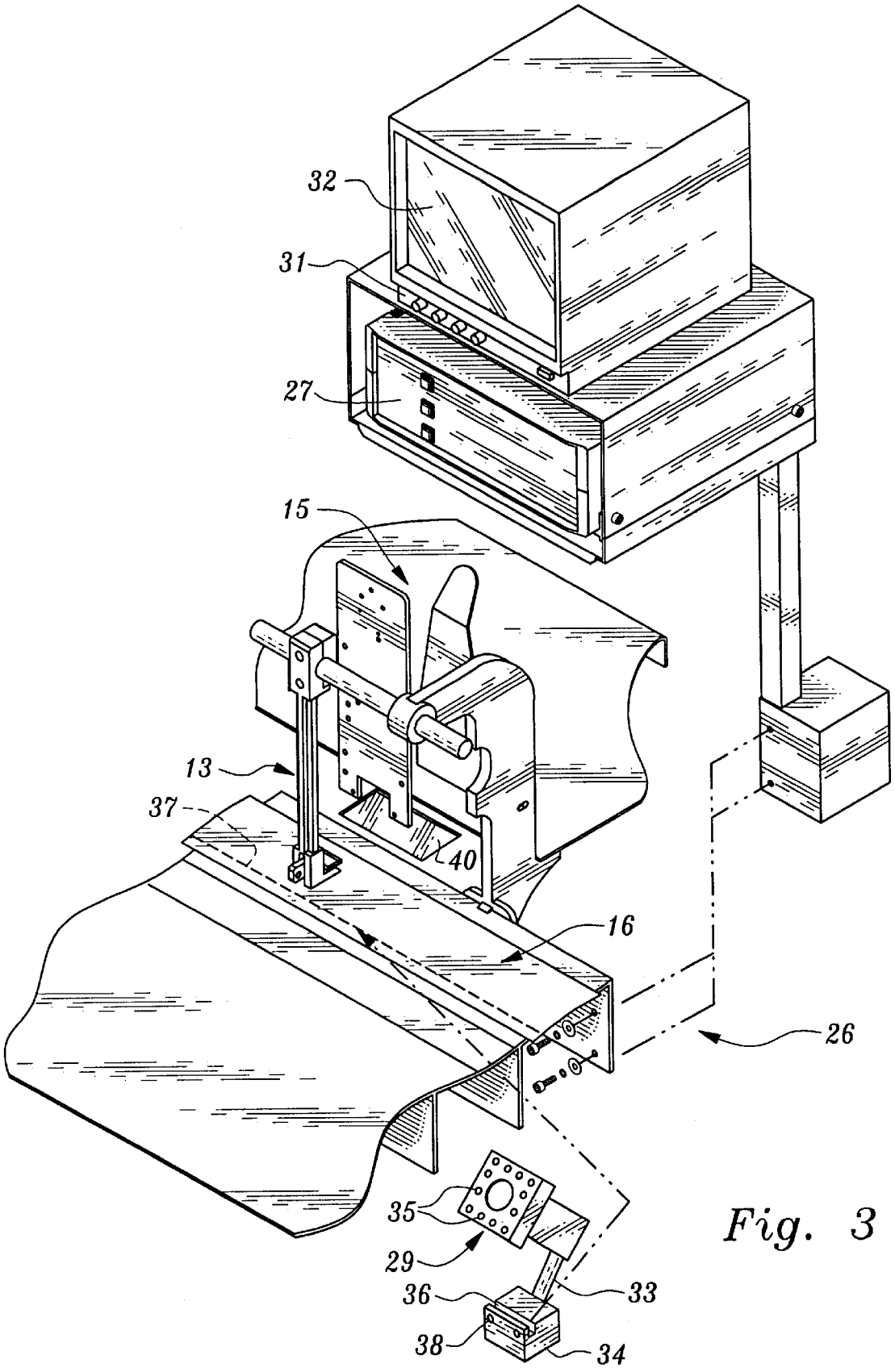
FIG. 3 is a fragmentary, exploded perspective view of the optical scanning station, showing the video monitor, the computerized system controller, the video camera, and a portion of the address panel hopper.
Figure 4:
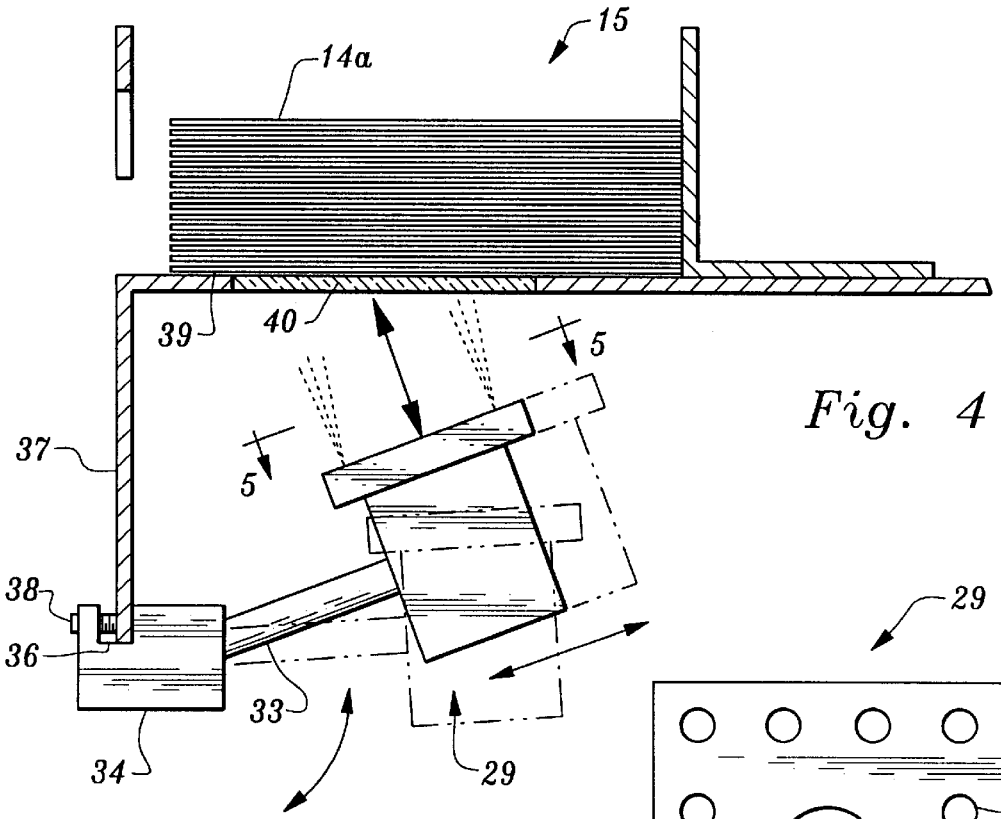
FIG. 4 is a median, transverse, cross-sectional view taken through the address panel hopper, showing the radially and rotationally adjustable mounting system for the video camera.

The apparatus 11 is known in the trade as a "Phillipsburg-type" envelope insertion machine, employing a plurality of insert hoppers 12 and a plurality of respective gripper jaw assemblies 13. Stacks of like documents 14, such as billing sheets, or advertising inserts are placed into a respective hopper 12. A stack of address panels 14*a* is placed into an address panel hopper 15. For clarity, no documents are shown loaded into the apparatus 11, as it is depicted in FIG. 1. However, by making reference to FIG. 2, both the handling and the processing of the documents as they pass through the apparatus 11 will become evident.

When the inserting machine is placed into operation, the plural gripper jaw assemblies 13 are rotated in synchronism, back and forth, through a limited arc of movement, in reciprocating fashion. During each cycle, the operable jaws "pick" or grip an individual one of the documents from the bottom of an adjacent stack, and deposit the document upon a conveyor 16. As the conveyor proceeds past the line of gripper jaws, and successive documents are deposited thereon, individual stacks of envelope contents 17 are formed.

A stack of envelopes 18 is stored within an envelope hopper 19. A lowermost envelope is slid out from under the stack, and its sealing flap is folded back into an open position. The prepared envelope is then transported to a content inserting station 21. Pushing forks 22 are provided at the inserting station to urge a completed stack of envelope contents 17 into the waiting envelope 18. The envelope sealing flap is subsequently wetted, and folded back over the rear envelope panel into a sealed position.

Thereafter, the sealed envelope 18 is transported by a conveyor 20 to an envelope collection tray 23, including a tray conveyor 25. In the tray 23, successive envelopes are preferably stacked in shingled fashion, with the front panel of one envelope lying in slightly offset horizontal relation over the rear panel of the underlying, neighboring envelope. This is accomplished by the new envelope being delivered into the tray 23, just after the relatively slowly moving tray conveyor 25 has shifted the previous envelope out of its initially delivered position. The envelopes are thereby oriented so their bottom edges are visible to the machine operator. After a plurality of envelopes is delivered to the collection tray 23, the envelopes form an elongated, horizontal stack, ready for segregating into like groups of zip codes or postal delivery routes. It should also be noted that the envelopes may be arranged in the collection tray with their side edges vertically oriented, and their upper edges co-planar and facing upwardly. For the purposes of practicing the present invention, either method of assembling the envelopes may be used.

To assist the machine operator in the process of identifying two adjacent envelopes which have dissimilar zip codes or postal delivery routes, the indicia detecting and marking apparatus 24 of the present invention is provided. The apparatus 24 accomplishes this by placing appropriate marks on the lower or upper edges of the envelopes, preferably after they are sealed but before they are transported to the collection tray 23 for stacking.

The apparatus 24 includes three basic components: a scanning station 26; a computerized system controller 27; and, a marking station 28. First, the attribution of each of these components will be explained. Then, their cooperative function in connection with the envelope inserting apparatus 11, described above, will be set forth.

The scanning station 26 includes a video camera 29, a video analyzer 30, a camera controller 31, and a video monitor 32. The video camera, the video analyzer, and the camera controller are all components of a video camera system manufactured by Omron Electronics, Inc. of Japan. This camera system is presently sold under the Omron model designation "F-30". Omron Electronics products are currently sold through the Industrial Automation Division of Omron U.S.A, located in Schaumburg, Illinois. The model F-30 has the capability of scanning a predetermined area of an object, storing reflectivity values for either black or white pixels within that area, comparing the stored values to plural predetermined ranges of values, and outputting respective signals corresponding to the range which is correlated. Although this particular camera system has proven useful in practicing the invention successfully, other video camera systems may be used as well.

Figure 5:
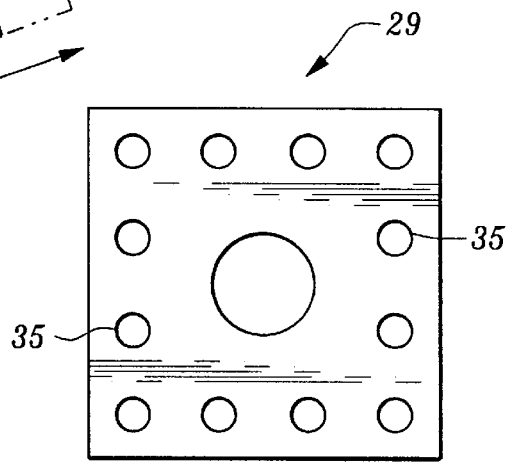
FIG. 5 is a front elevational view of the video camera taken on the line 5—5 in FIG. 4, showing the array of illuminating LEDS and the video camera lens.
Figure 6:
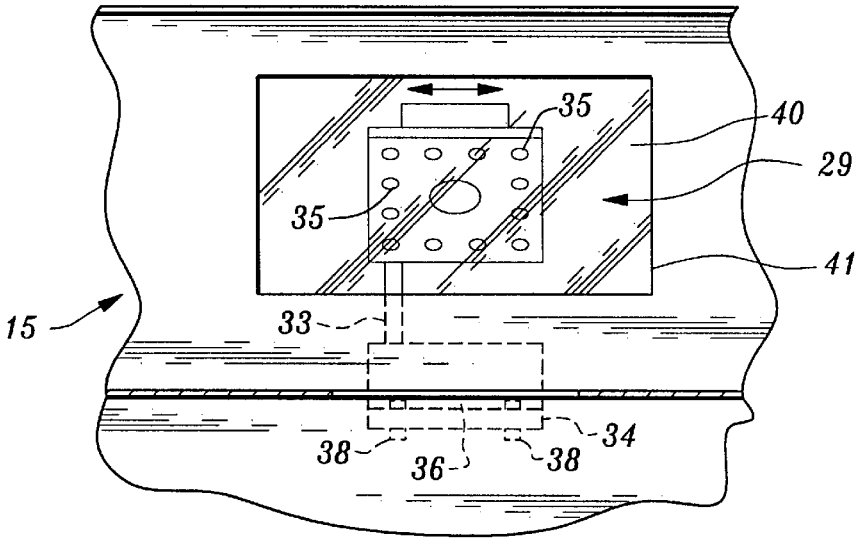
FIG. 6 is a fragmentary top plan view of the address panel hopper, showing the address panel exposure window and the longitudinally adjustable mounting system for the video camera.
Figure 7:
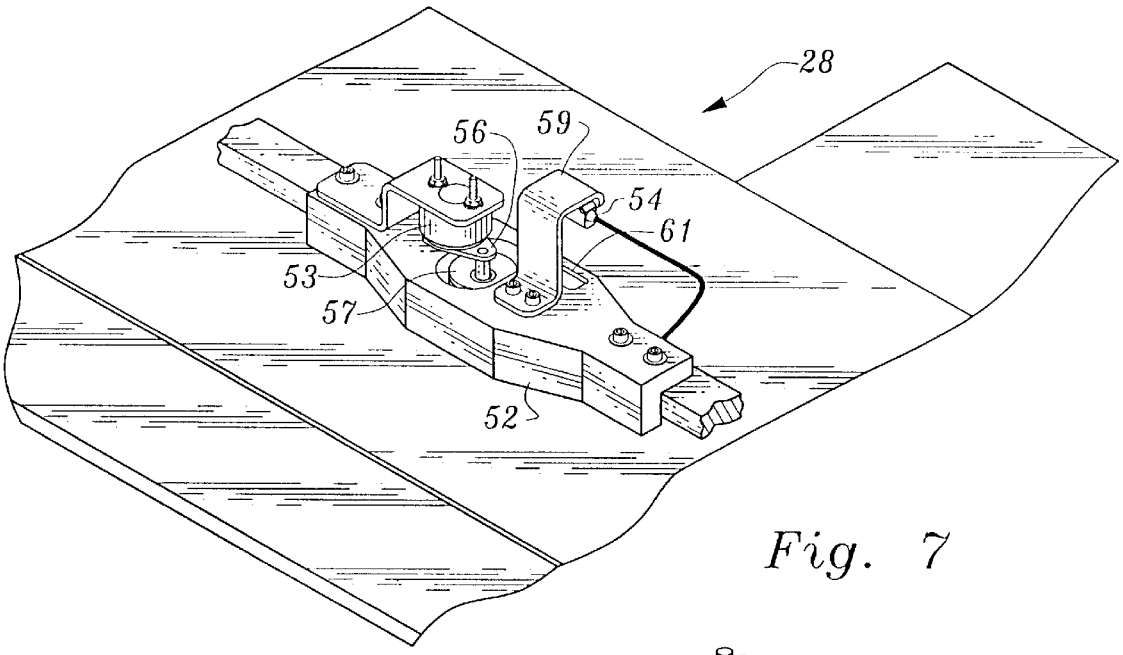
FIG. 7 is a right front perspective view of the marking station.

The video camera 29 is located beneath the address panel hopper 15, with its lens directed upwardly toward the face of a lowermost address panel 39. So that visual information on the face of panel 39 may be viewed by the camera, a glass plate 40 is provided within a rectangular cutout 41, in the floor of hopper 15. The video camera 29 is pivotally attached to an extension arm 33, which is also pivotally attached to a mounting block 34. Block 34 is provided with an elongated recess 36, sized slidably to accommodate a lower edge of plate 37. A pair of screws 38 secures mounting block 34 to plate 37 in a selected location along plate 37. By selective adjustment of the location of block 34 and arm 33, the camera 29 can be located in the desired position and orientation beneath cutout 41, so that the camera will have a clear view of the desired portion of panel 39. As shown most clearly in FIG. 5, the camera 29 also includes an array of light emitting diodes 35 to illuminate the address panel 39 for optical viewing.

Typically, a large area of the address panel 39, including both the customer's address and any pre-marked indicia appearing thereon, is within the field of view of the camera's lens. The camera's field of view is constantly displayed on the video monitor 32 for the machine operator to monitor both during the system calibration process and during the normal operation of the apparatus (see, FIGS. 10–12).

The camera controller 31 is interconnected to the video camera 29. The camera controller includes a calibration mode. In this calibration mode, the user selects a smaller, predetermined area within the camera's larger field of view, to define an operative scanning area 42 for the camera. This is accomplished by the operator viewing an actual address panel 39 on the video monitor 32, and electronically drawing a small box or rectangle outlining the area 42 where the pre-marked indicia of interest, if any, appear. By appropriately locating and sizing the operative scanning area 42, other extraneous markings on the address panel, such as customer information 43, are located outside the operative scanning area 42.

Figure 10:
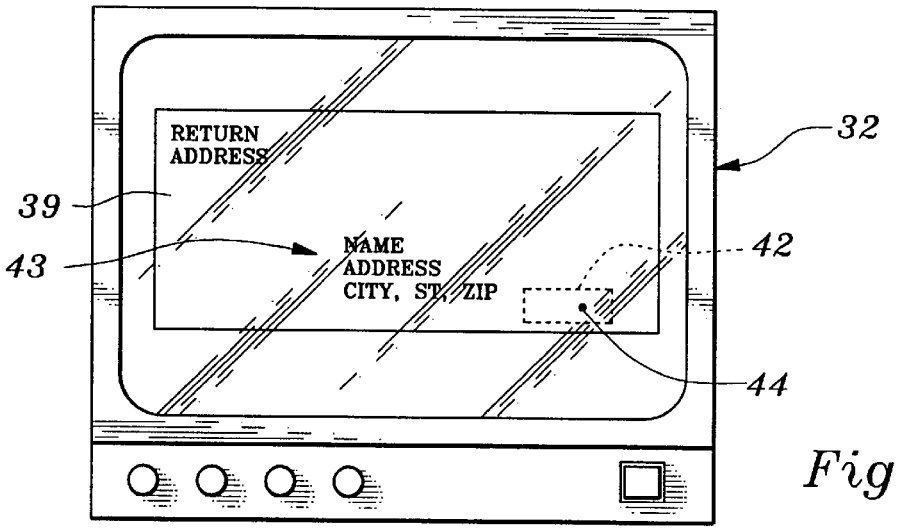
FIG. 10 is a front elevational view of the video monitor, showing a single pre-marked indicia in the predetermined, operative scanning area.
Figure 11:
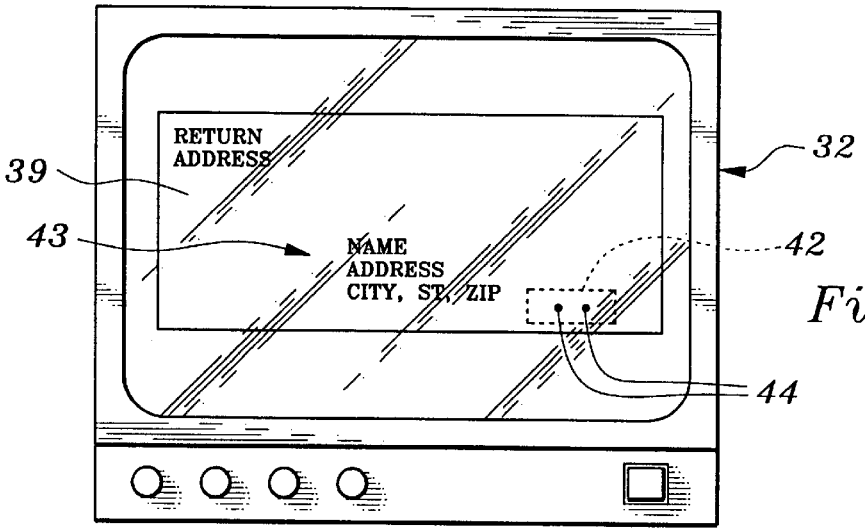
FIG. 11 is a view as in FIG. 10, but showing two pre-marked indicia in the operative scanning area.
Figure 12:
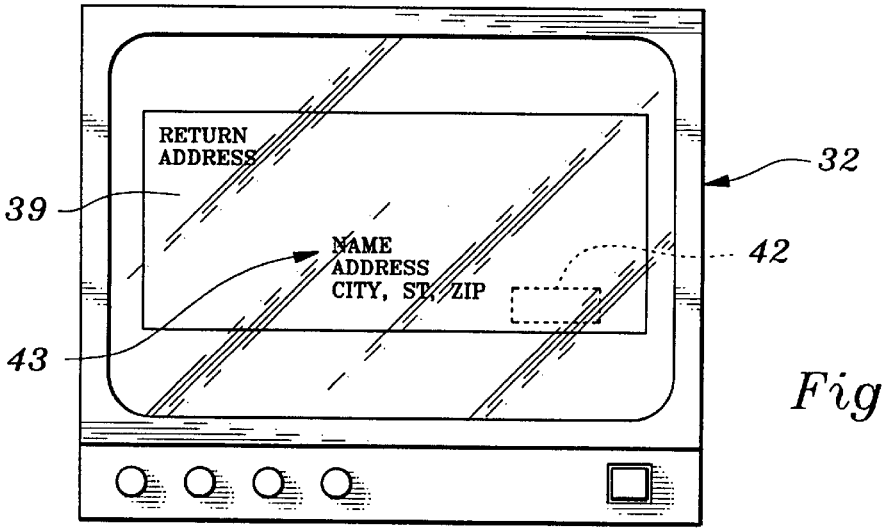
FIG. 12 is a view as in FIG. 10, but showing no pre-marked indicia in the operative scanning area.

For example, in FIG. 10, the operative scanning area 42 embraces a single indicia 44; in FIG. 11, area 42 overlays a pair of indicia 44; and, in FIG. 12, area 42 defines the predetermined area where indicia, if any, are supposed to be, but none is present. Some prior art systems rely upon a precise location for indicia, and may give false readings if indicia are printed slightly out of location or if the address panel is misaligned within the address panel hopper 15. However, the camera 29 of the present apparatus 24 is not sensitive as to the position, location, or configuration of the indicia, as long as they are somewhere within the operative scanning area 42. By defining and limiting the operative scanning area 42 to a predetermined area where indicia and only indicia are supposed to be, the overall accuracy and reliability of the apparatus are enhanced.

The camera's output 46 to the video analyzer 30, includes the only the pixel information for the operative scanning area 42. The analyzer 30 first assesses the reflectivity value for each pixel against a gray scale standard, and determines whether each pixel is a white pixel or a black pixel. Next, the analyzer 30 counts the number of black pixels within the area 42. Then, the analyzer compares the total count of black pixels to predetermined values or percentage ranges. Finally, the analyzer outputs a signal corresponding to the outcome of the comparison determination.

For example, in the Omron F-30, three ranges are defined as: low, OK, and high. There are default settings for these ranges which may be user modified to accommodate different numbers and sizes of indicia, for the present application. The default settings for the ranges of black pixel counts, are as follows: Low, 0–80%; OK, 80%–120%; High, 120% and higher. Other prior art systems, such as the OCR, are programmed to recognize only a particular size and configuration for a character. In contrast, the video analyzer 30 of the present system does not need to discriminate between different shapes of indicia, because it simply counts the black pixels, without regard to the shape of the indicia that include the black pixels. As a consequence, the analyzer is easily calibrated to accommodate indicia of different shapes, sizes, and numbers. It should also be noted that the Omron video analyzer can alternatively be programmed by the user to count and compare white pixels, but owing to the type of indicia used for the present application, the counting of black pixels is the selected manner of operation for the analyzer herein.

In the preferred manner of using the present apparatus, the video analyzer 30 is also calibrated to make marking determinations, in the following manner. An address panel 39, including a single indicia 44, such as an asterisk, a dot, a star, or any other indicia of choice, is placed facing down within the address panel hopper 15. After the operative scanning area 42 has been electronically drawn around the single indicia 44, as shown in FIG. 10, the operator samples the output of the video analyzer. If the analyzer determines that a single indicia produces a pixel count that falls within the range of 80–120% of a normalized, or median pixel count, the analyzer produces a first control signal being outputted through OK line 47. If necessary, the analyzer 30 can be adjusted so that its "OK", or median pixel count range, embraces the pixel count of the single indicia. Alternatively, the size of the indicia or mark can be increased or decreased, with the same result.

After this calibration step, the operator confirms proper operation of the analyzer for the other two address panel possibilities: either two indicia, or no indicia at all. To accomplish this, the operator places a different address panel 39, containing two indicia 44, into the address panel hopper 15. The operator should then see the panel on the video monitor 32, as shown in FIG. 11, with the indicia 44 located within the boundaries of the operative scanning area 42. The scanned pixel count should significantly exceed 120%, resulting in a second control signal being outputted from the analyzer through High line 48. (See, FIG. 13). Lastly, yet another address panel 39, containing no indicia, is loaded into the hopper. The operator viewing the video monitor should see the representation of the address panel shown in FIG. 12. As indicated, no indicia or marks are within the operative scanning area 42. The scanned pixel count should fall well below 80%, resulting in a third control signal being outputted from the analyzer through the Low line 49.

Figure 13:
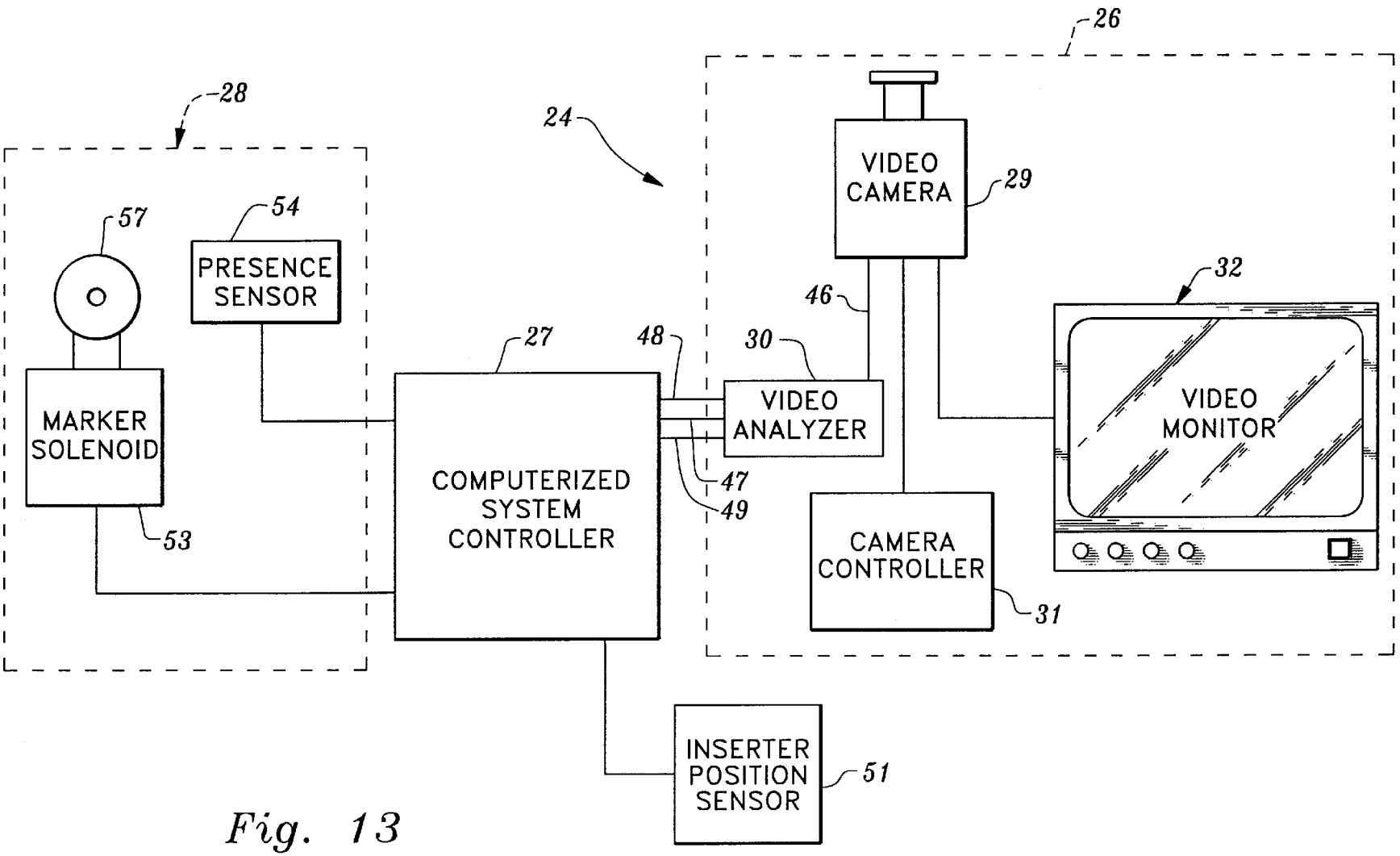
FIG. 13 is a schematic representation of the major components of the apparatus of the present invention; and, FIG. 14 is a flow chart, showing the operational process of the indicia detection and marking station.

The computerized system controller 27 is interconnected to the output of video analyzer 30 through the aforementioned OK line 47, the High line 48, and the Low line 49. As shown in FIG. 13, controller 27 is also interconnected to an inserter position sensor 51. Sensor 51 is preferably an optical encoder, attached to a rotational drive shaft for operating certain components of the envelope inserting apparatus 11. In this manner, sensor 51 monitors the repetitive, operational cycle of the inserting apparatus. Of particular interest herein, are the location and status of each address panel 39 during the operational cycle of the inserter. For the purposes of scanning each address panel 39 for indicia, the position sensor 51 produces an output which tells the system controller 27 when a new panel 39 is within the field of view of the camera 29, and the panel is stationary so that it can be scanned accurately. Once the "picture" of the address panel 39 has been taken by sampling the operative scanning area 42, the panel is then clutched by the gripper jaw 13, and transported to conveyor belt 16.

The computerized system controller 27 counts the operational cycles of the inserter, and in this manner keeps track of the location of each address panel as it passes through the machine. By the time a particular address panel has reached the marking station 28, it has already been combined with a number of inserts and inserted into an envelope which has been sealed. Based upon the determination made previously and outputted by the video analyzer, the controller makes a further determination whether or not the envelope is to be marked, and if so, what type of a mark it should be.

Figure 9:
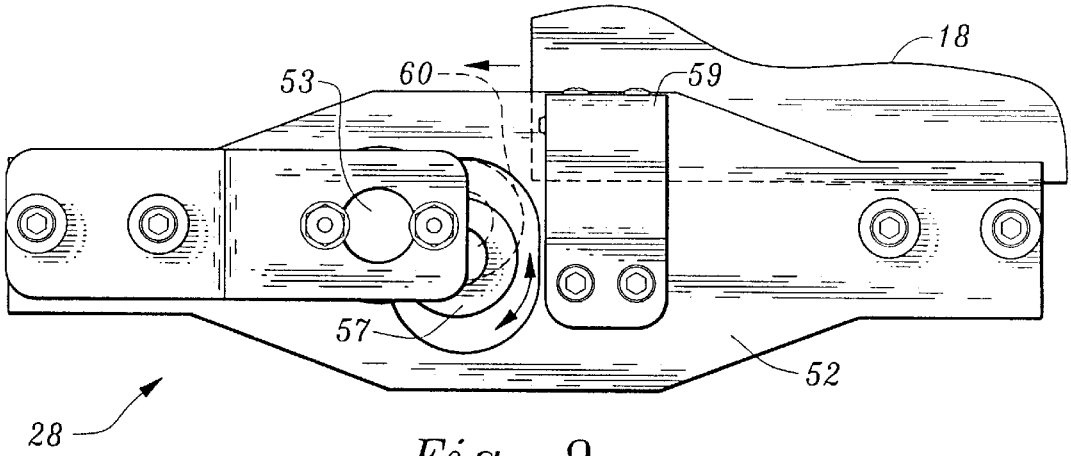
FIG. 9 is a top plan view of the marking station, showing a portion of an envelope passing through the station, about to be edge marked.

The marking station 28 includes a sub-chassis 52, upon which a marker solenoid 53 and an envelope presence sensor 54 are mounted. Solenoid 53 has an arm 56 attached to its operable element. A circular ink pad 57 depends from an outer end of the arm. Pad 57 is located within a channel 58, defining a path through which a portion of each envelope 18 passes. When solenoid 53 is actuated by an electrical marking signal produced by system controller 27, the solenoid rotates arm 56 and pad 57 from a first, retracted position to a second, extended position. The extended position is represented by a broken line 60, shown in FIG. 9. The duration of the marking signal determines how long the pad will be held in the extended position, and how physically long the resultant mark will be as well. When the marking signal ceases, the solenoid automatically withdraws to the retracted position.

Figure 8:
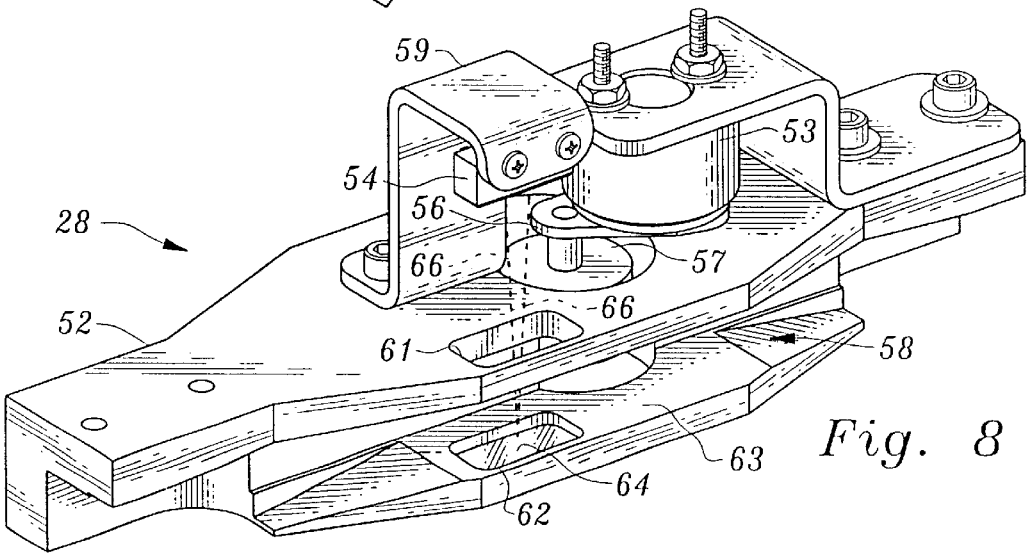
FIG. 8 is left front perspective view, showing the rear side of the marking station.

The envelope presence sensor 54 is preferably of a retro-reflective design, including both a light emitting diode and a companion optical detector element, in one sensor package. The sensor 54 is mounted on a bracket 59, so that light from the light emitting diode is directed downwardly, passing through an aperture 61. A recess 62 is provided in a lower plate 63 of the sub-chassis 52. A reflector element 64 is secured within the recess, slightly below the upper surface of plate 63. Light from the light emitting diode impinges upon the reflector element 64, and is directed back upon the detector element of the sensor. The path traversed by the incident and reflected light beams is shown in broken line in FIG. 8, and identified by the numeral 66. The sensor 54 produces an envelope detection pulse when at least one of the beams is interrupted by a passing envelope 18. Many other equivalent sensor arrangements may be used in this application, such as a separate illuminator beneath the sub-chassis, directed upwardly toward an optical detector element. Also, a sensor which depends upon light reflecting from a passing envelope, rather than interruption of a beam, may be used as well.

As shown in FIG. 13, both the marker solenoid 53 and the presence sensor 54 are interconnected to the system controller 27. The presence sensor 54 confirms for the controller 27, that an envelope, in fact, is present at the marking station 28. This confirmation is necessary, before any envelope marking operation can be initiated. If an envelope is present, and the controller 27 has determined that it is an envelope which should be marked, an electrical marking signal, of the appropriate duration in accordance with the previously detected indicia, is sent to the marker solenoid. The marker solenoid is actuated, rotating the ink pad against a peripheral edge of the passing envelope, and marking it with either a long mark or a short mark. Depending upon the design of the collection tray 23, either the bottom edge or the top edge of the envelope will be marked. Then, the envelope will be passed on to the collection tray, where it will be arranged in stacked or facing relation with other envelopes. The orientation of the envelopes will be such that any markings made along any peripheral edges of the envelopes will be exposed and evident to the machine operator.

Figure 14:
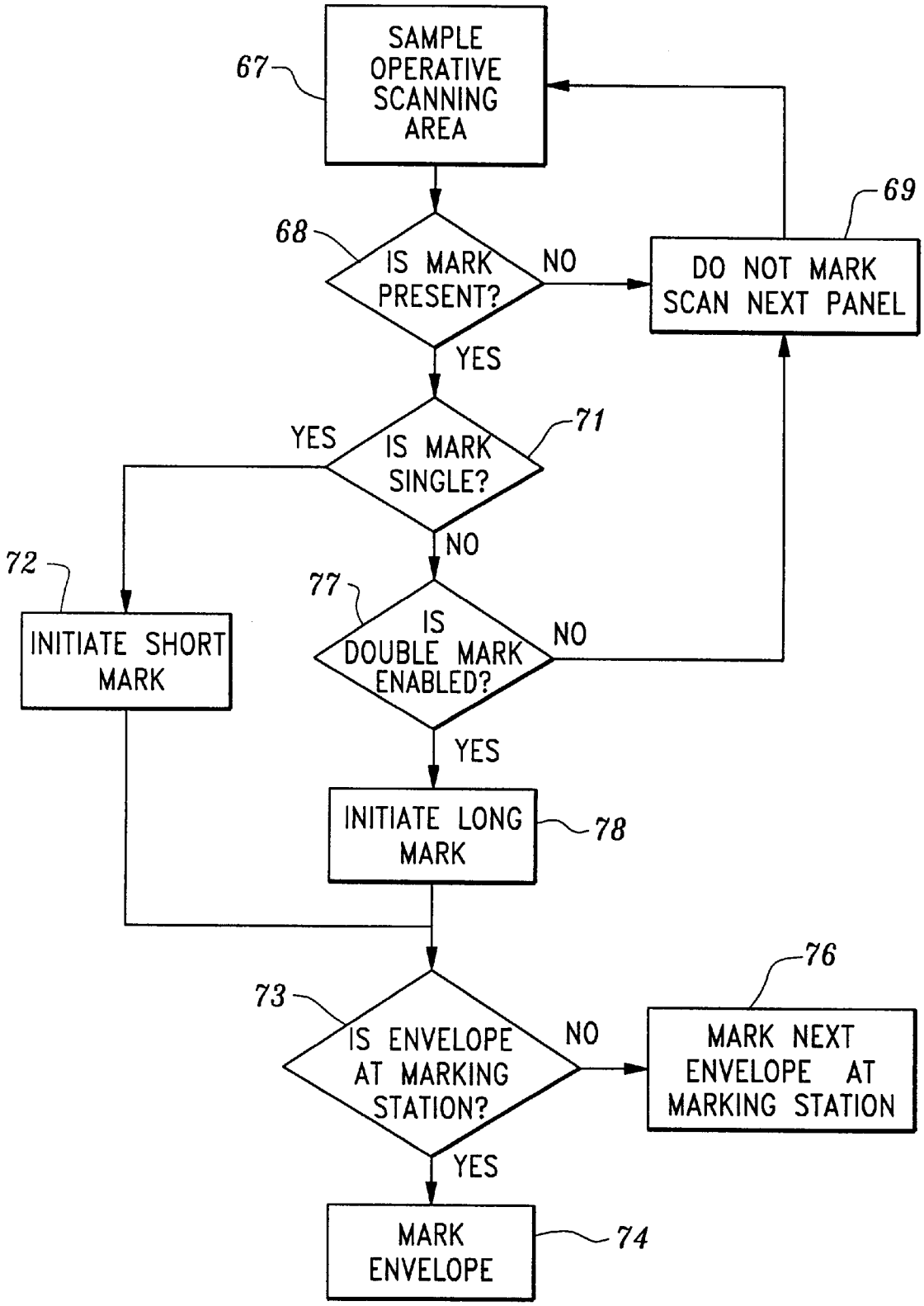

FIG. 14 summarizes the operation of the apparatus 24. In a first step 67, performed at the scanning station, the camera 29 and the camera controller 31 function to sample the operative scanning area 42 of an address panel, for black pixels. In step 68, the video analyzer 30 determines whether or not the cumulative numbers of black pixels, if any are detected, at least meet the threshold of the median, OK range, indicating that a mark or indicia is present. If the threshold of the median range is not met, a signal is outputted over the Low line 49, telling the system controller in step 69 that the address panel 39 does not have any indicia or marking, so the outer periphery of the envelope should not be marked. In that event, the scanning station then prepares to scan the next address panel.

In step 71, the video analyzer 30 determines whether the indicia is a single or a double. If it is a single mark, because the scanned pixel value falls between 80% and 120% of the normalized, median range, the analyzer outputs a signal over the OK line 47. The system controller initiates a short mark, in step 72. Immediately thereafter, in step 73, the controller samples the presence sensor 54, answering the question whether an envelope is present at the marking station 28. If an envelope is present, in step 74, the controller sends a short marking signal to the marking solenoid, thereby marking the envelope with a short mark 70 (see, FIG. 2). If not, the controller continues to sample the presence sensor until an envelope is present at the marking station, and then it sends a short marking signal to the marking solenoid to mark the next envelope, in step 76

If the analyzer determines that the mark is not a single, it then determines, in step 77, whether the double mark operational feature of the apparatus is enabled or not. In some applications, it is only desirable to detect a single mark or indicia, in which case the double mark feature in the system controller 27 would be disabled. If the mark is not a single and the double mark feature is disabled, detection of a double mark at the scanning station would indicate a fault condition for the panel. In that instance, the controller 27 determines not to mark the envelope, and prepares the system to receive information regarding the next scanned address panel.

If the mark is a double, and the double mark feature is enabled, the controller initiates a long mark in step 78. Providing the controller also determines that an envelope is present, the envelope will be marked with a long mark 75, in step 74 (see, FIG. 2). If an envelope is not present, the controller will send a long marking signal to the marking solenoid, when the next envelope is present at the marking station.

It will be appreciated then, that we have disclosed an apparatus and a method for optically scanning an article for indicia pertaining to a characteristic of a group of articles, determining whether any detected indicia satisfy predetermined criteria, inserting the article into a container, and then marking the container for later identification of the group if the predetermined criteria are satisfied.

We claim:

1. An apparatus for marking the container of an article, in which the article has been pre-marked with at least one indicia, comprising:

a. an optical scanning station, including a video camera programmed to view an operative scanning area on the article, the indicia being located within said operative scanning area, and further including a video analyzer responsive to an output of said video camera, in which said video analyzer assesses each pixel within said scanning area, adds up the total number of pixels having a desired characteristic, compares the pixel count to predetermined criteria correlating to the presence of an indicia, and produces a first control signal if the criteria are satisfied b. means for inserting the article into the container;

c. a marking station, including means for marking the container with the article therein, and further including sensor means for detecting the presence of the container; and d. a computerized system controller, said controller being responsive to said first control signal and said means for detecting the container at said marking station, said controller producing a marking signal effective to actuate said means for marking the container.

2. An apparatus as in claim 1, in which said scanning station further includes a camera controller and a video monitor interconnected to said camera, said camera controller electronically defining said operative scanning area, and at least a portion of the article and said operative scanning area being displayed on said video monitor.

3. An apparatus as in claim 2, in which the container is an envelope and the article is an address panel.

4. An apparatus as in claim 3, including an address panel hopper adjacent said optical scanning station, and in which said video camera is directed toward said hopper and the operative scanning area of an address panel therein.

5. An apparatus as in claim 1 in which said means for marking the container includes a solenoid having an arm with an ink pad thereon, said arm being movable from a first retracted position withdrawn from a path of the envelope, to a second extended position in which said pad comes into contingent relation with an exterior surface of the envelope.

6. An apparatus as in claim 1 in which said sensor means includes a light emitting diode and an optical detector element.

7. An apparatus as in claim 6 in which said diode and said detector element are in adjacent relation, and directed toward a reflector element, said diode producing an incident beam upon said reflector element, and said reflector element producing a reflected beam toward said detector element, said incident and reflected beams extending transversely through a path of the container.

8. An apparatus as in claim 1, in which said video analyzer produces a second control signal when at least two indicia are detected in said operative scanning area, and in which said controller produces a marking signal of a different duration than said marking signal produced when an indicia is detected.

9. An apparatus as in claim 8, in which said video analyzer produces a third control signal when no indicia are detected in said operative scanning area, and in which said controller produces no marking signal in response to said third control signal.

10. An envelope inserting apparatus for inserting an address panel into an envelope, the front of the address panel being pre-marked with at least one indicia in an operative scanning area thereon, comprising:

a. a frame;

b. an optical scanning station mounted on said frame, said station including: an address panel hopper for the address panel; a video camera programmed to view the operative scanning area on the address panel; and, a video analyzer responsive to an output of said video camera, in which said analyzer assesses each pixel within said scanning area, adds up the total number of pixels having a desired characteristic, compares the pixel count to predetermined criteria correlating to the presence of an indicia, and produces a first control signal if the criteria are satisfied c. an inserting station on said frame, said inserting station including pushing forks for urging the address panel into the envelope;

d. a marking station on said frame, said marking station including means for marking the envelope with the address panel therein, and further including and sensor means for detecting the presence of the envelope; and, e. a computerized system controller, said controller being responsive to said first control signal and said means for detecting the container at said marking station, said controller producing a marking signal effective to actuate said means for marking the container.

11. An apparatus as in claim 10, in which said scanning station further includes a camera controller and a video monitor interconnected to said camera, said camera controller electronically defining said operative scanning area, and at least a portion of the article and said operative scanning area being displayed on said video monitor.

12. An apparatus as in claim 10 in which said means for marking the envelope includes a solenoid having an arm with an ink pad thereon, said arm being movable from a first retracted position, withdrawn from a path of the envelope, to a second extended position, in which said pad comes into contingent relation with an exterior surface of the envelope.

13. An apparatus as in claim 10 in which said sensor means includes a light emitting diode and an optical detector element.

14. An apparatus as in claim 13 in which said diode and said detector element are in adjacent relation, and directed toward a reflector element, said diode producing an incident beam upon said reflector element, and said reflector element producing a reflected beam toward said detector element, said incident and reflected beams extending transversely through a path of the container.

15. An apparatus for externally marking an envelope which has been inserted with an address panel including at least one indicia in an operative scanning area thereon, comprising:

a. an optical scanning station, said station including a video camera and a video analyzer, said video camera being programmable to scan only the operative scanning area of the address panel, said video analyzer assessing each pixel within the scanning area and adding up the total number of pixels having a desired characteristic, then comparing the pixel count to predetermined criteria correlating to the presence of an indicia and producing a first control signal in response thereto;

b. means for inserting the address panel into an envelope;

c. a marking station, said marking station including an envelope presence sensor; and, d. a computerized system controller, said controller having one input responsive to said control signal and another input responsive to an output of said envelope presence sensor, said controller producing a marking signal effective to actuate said marking station to mark the envelope when its presence is sensed at the marking station.

16. An apparatus as in claim 15 in which said envelope presence sensor includes a light emitting diode and an optical detector element.

17. An apparatus as in claim 16 in which said diode and said detector element are in adjacent relation, and directed toward a reflector element, said diode producing an incident beam upon said reflector element, and said reflector element producing a reflected beam toward said detector element, said incident and reflected beams extending transversely through a path of the envelope.

18. A method for scanning an article for indicia and marking a container of the article if indicia detected on the surface of the article satisfy predetermined criteria, comprising the steps of:

a. defining an operative scanning area on the surface of the article, where indicia may appear;

b. optically scanning each pixel within the operative scanning area;

c. counting and storing the number of detected pixels scanned, which satisfy a predetermined characteristic;

d. comparing the stored number to at least one predetermined range of pixel numbers;

e. producing a marking signal if the stored number falls within the predetermined range;

f. inserting the article in the container; and g. marking the container of the article, in response to said marking signal.

19. An apparatus for marking the container of an article, in which the article has been pre-marked with at least one indicia, comprising:

a. an optical scanning station, including a video camera programmed to view an operative scanning area on the article, and further including a video analyzer responsive to an output of said video camera, said analyzer producing a first control signal when an indicia is detected in said operative scanning area and a second control signal when at least two indicia are detected in said operative scanning area;

b. means for inserting the article into the container;

c. a marking station, including means for marking the container with the article therein, and further including sensor means for detecting the presence of the container; and, d. a computerized system controller, said controller being responsive to said first control signal, said second control signal, and said means for detecting the container at said marking station, said controller producing a marking signal effective to actuate said means for marking the container, and in which said controller produces marking signals of different durations in response to said first and second control signals.

20. An apparatus for marking the container of an article, in which the article has been pre-marked with at least one indicia, comprising:

a. an optical scanning station, including a video camera programmed to view an operative scanning area on the article, and further including a video analyzer responsive to an output of said video camera, said analyzer producing a first control signal when an indicia is detected in said operative scanning area, a second control signal when at least two indicia are detected in said operative scanning area, and a third control signal when no indicia is detected in said operative scanning area;

b. means for inserting the article into the container;

c. a marking station, including means for marking the container with the article therein, and further including sensor means for detecting the presence of the container; and, d. a computerized system controller, said controller being responsive to said first control signal, said second control signal, said third control signal, and said means for detecting the container at said marking station, said controller producing a marking signal effective to actuate said means for marking the container, and in which said controller produces marking signals of different durations in response to said first and second control signals, and in which said controller produces no marking signal in response to said third control signal.

* * * * *